US005647651A

United States Patent [19]

Kim

[11] Patent Number: 5,647,651

[45] Date of Patent: Jul. 15, 1997

[54] MEDICINE CABINET WITH LOCKABLE STORAGE COMPARTMENT

[75] Inventor: Young R. Kim, Pomona, Calif.

[73] Assignee: Pacific Precision Metals, Inc., Azusa, Calif.

[21] Appl. No.: 430,336

[22] Filed: Apr. 28, 1995

[51] Int. Cl.[6] ..... A47B 81/00

[52] U.S. Cl. ..... 312/291; 312/209; 312/310

[58] Field of Search ..... 312/291, 310, 312/209, 227, 351; 108/109, 110

[56] References Cited

U.S. PATENT DOCUMENTS

| | | | |
|---|---|---|---|
| 2,321,921 | 6/1943 | Lathrop | 312/209 |
| 3,008,785 | 11/1961 | Gehrs | 312/291 |
| 4,225,203 | 9/1980 | Goodrode | 312/291 |

*Primary Examiner*—Peter M. Cuomo
*Assistant Examiner*—Gerald Anderson
*Attorney, Agent, or Firm*—Brown, Martin, Haller & McClain

[57] ABSTRACT

A lockable storage compartment can be mounted in and removed from a medicine cabinet housing in a manner similar to that in which the shelves are mounted and removed. The storage compartment includes a fixed panel and a movable panel. The movable panel is connected to the fixed panel by one or more hinges at the forward edge of the fixed panel and can be swung to open or close the storage compartment. The storage compartment may have a catch that is releasable only from inside the storage compartment for preventing removal of the storage compartment from the medicine cabinet when the storage compartment is closed and locked.

9 Claims, 2 Drawing Sheets

MEDICINE CABINET WITH LOCKABLE STORAGE COMPARTMENT

BACKGROUND OF THE INVENTION

The present invention relates generally to medicine cabinets and, more specifically, to interior shelving arrangements for medicine cabinets.

Medicine cabinets of the type used in bathrooms of residential dwellings for storing articles such as medicines and personal hygiene products typically have a rectangular, pan-shaped housing with a hinged door. The door may have a mirror, and the cabinet may be mounted in a recessed manner in the bathroom wall. The interior of the housing typically has multiple removable shelves. Each shelf extends across the width of the housing with the ends of the shelf retained in horizontal slots on the cabinet side walls. The slots are vertically spaced to provide multiple mounting positions for the shelves.

It is desirable for multiple members of a household to share the use of a medicine cabinet. Yet conventional medicine cabinets may present a danger to children and those with mental or visual impairments who require access to relatively innocuous articles, such as toothpaste tubes, mouthwash bottles and first aid supplies, because potentially harmful articles, such as drugs, iodine and razor blades, may also be stored in the cabinet. It would be desirable to prevent unauthorized persons from accessing certain potentially harmful articles while allowing them to access other articles stored in the cabinet. These problems and deficiencies are clearly felt in the art and are solved by the present invention in the manner described below.

SUMMARY OF THE INVENTION

The present invention comprises a lockable storage compartment for a cabinet, such as a medicine cabinet, that has a housing and a plurality of movable or relocatable shelves. The storage compartment may be provided with the cabinet or may be used in existing cabinets as an accessory.

The cabinet housing is generally pan-shaped and comprises a rear wall, two side walls, an upper wall and a lower wall. The housing may be a conventional medicine cabinet housing, which is particularly desirable in embodiments in which the storage compartment is to be used as an accessory for existing cabinets. A door having a mirror may be attached to the front edge of one side wall.

The shelves are removably mountable in the housing. When mounted in the housing, each shelf extends at least partially across the width of the housing. Mountings are vertically spaced on each side wall to provide multiple vertical positions for mounting the shelves. A shelf that extends the full width of the housing may be mounted by engaging the ends of the shelf with opposing mountings on the sidewalls. Nevertheless, additional mountings may be vertically spaced on the rear wall of the housing, between the side walls, as described in the present inventor's copending application Ser. No. 08/179,066, now U.S. Pat. No. 5,424,196 entitled "MEDICINE CABINET WITH RELOCATABLE CANTILEVER SHELVES," filed Jan. 10, 1994. The medicine cabinet described in that patent application has shelves that extend less than the full width of the housing. A shelf may thus be mounted by engaging one end of the shelf with a mounting on a side wall and the other end of the shelf with a mounting on the rear wall.

The storage compartment is removably mountable in the housing. The storage compartment comprises a fixed panel and a movable panel and may also include other suitable panels, walls or partitions. The fixed panel extends at least partially across the width of the housing and may be supported by engaging it with two mountings in a manner similar to that in which a shelf engages the mountings. The movable panel is connected to the fixed panel by one or more hinges.

The storage compartment may be removably mounted at any suitable vertical position in the housing. The movable panel is swingable between a closed position and an open position. The hinge or hinges may be arranged in any suitable manner, and the movable panel may swing in any suitable direction, but in the closed position the movable panel is perpendicular to the fixed panel and parallel to the rear wall of the cabinet housing. When the movable panel is in the closed position, it contacts either the forward edge of the lower wall of the housing or the forward edge of one of the shelves, thereby closing off the compartment. In an exemplary embodiment, the storage compartment panels consist only of the movable panel and the fixed panel. The interior volume of the storage compartment is thus bounded by or defined by the rear wall of the cabinet, the fixed panel, the movable panel, and either the housing lower wall or a shelf, depending on the location in the housing at which the compartment is mounted. Portions of both housing side walls define the interior of the storage compartment because the storage compartment extends the full width of the housing. Nevertheless, in other embodiments, including those in which the storage compartment extends only partially across the width of the housing, the storage compartment may comprise additional panels, such as rear panels and side panels, that further define and enclose the interior space of the storage compartment.

The movable panel has a locking mechanism of any suitable type that inhibits an unauthorized person from readily accessing the storage compartment. A locking member or post with which the locking mechanism mates when the storage compartment is locked is either mounted on or integrally formed in a wall of the housing, a shelf, or other suitable portion of the storage compartment.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
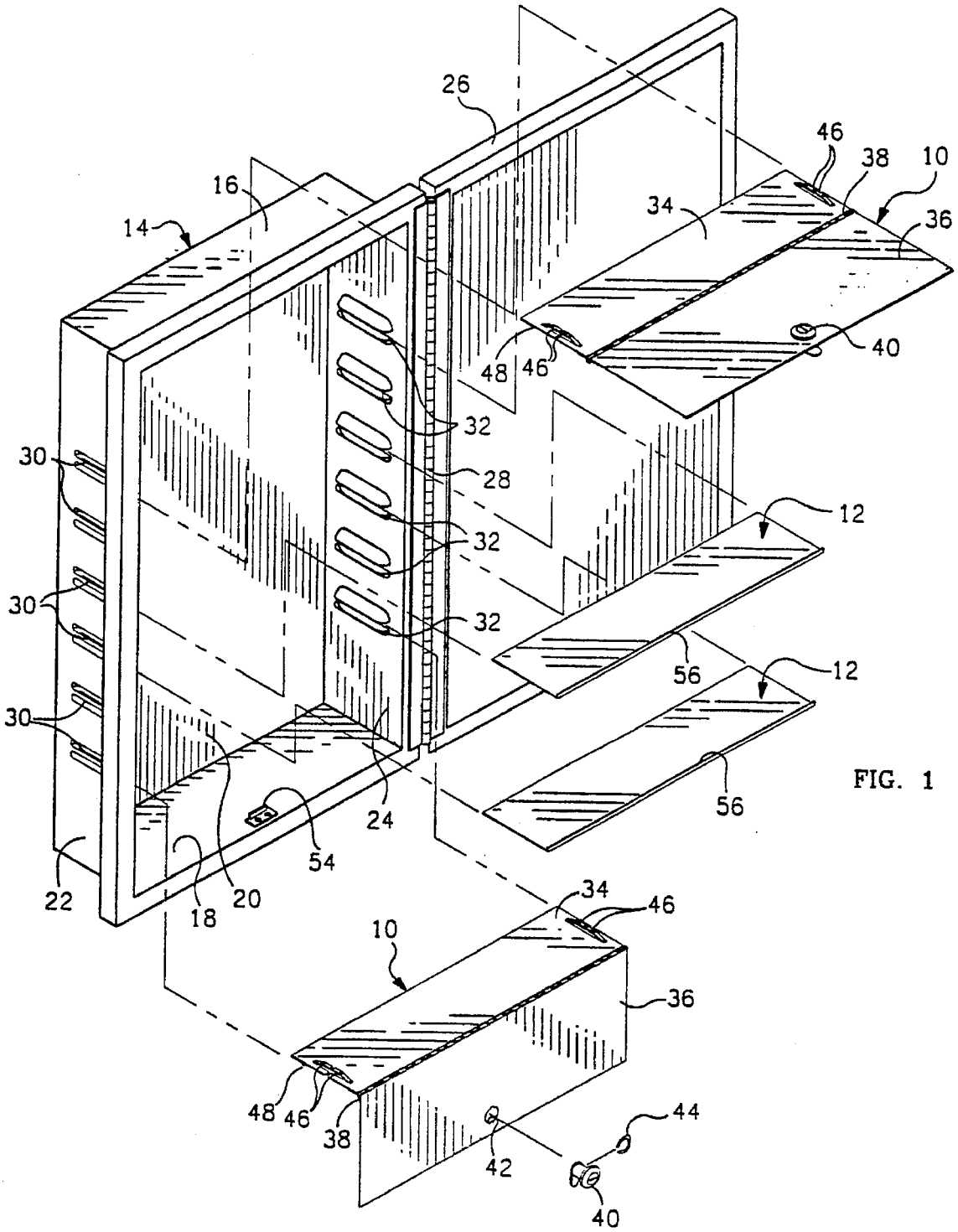
FIG. 1 is an exploded perspective view of a cabinet having removable shelves and storage compartments.

As illustrated in FIG. 1, one or more storage compartments 10 and one or more shelves 12 are removably mountable in a medicine cabinet housing 14. Housing 14 has an upper wall 16, a lower wall 18, a rear wall 20, and two side walls 22 and 24. Housing 14 and shelves 12 are preferably formed of sheet metal. Although they may be formed of any suitable metal of any thickness, good results were obtained using 26 gauge steel. A mirrored door 26 is connected by a piano hinge 28 to one of the side walls, such as side wall 24. Housing 14 is mountable in a wall (not shown) of a dwelling in a recessed manner.

Side walls 22 and 24 have a plurality of horizontal slots 30 and 32, respectively, vertically spaced from one another. Each slot 30 on side wall 22 is at the same vertical position as a corresponding slot 32 on the opposing side wall 24. Each pair of corresponding slots defines a mounting position at which a shelf 12 or a storage compartment 10 may be mounted. As shown in FIGS. 1–6, each of slots 30 and 32 may be formed in the conventional manner known in the medicine cabinet art by punching the sheet metal of the sidewall and bending two ears 33 inwardly.

Storage compartment 10 comprises a fixed panel 34 and a movable panel 36 connected by a piano hinge 38. Panels 34 and 36 are preferably formed of sheet metal. Although the sheet metal may be of the same type and thickness as in the remainder of housing 14, additional security may be provided by forming panels 34 and 36 of slightly thicker metal, such as 22 gauge steel. A key-operated lock 40 is mounted in an opening 42 in movable panel 36 and secured with a C-clip 44, as shown with respect to storage compartment 10 in FIG. 1.

To mount a shelf in housing 14, the opposite ends of the shelf are inserted in a pair of corresponding slots 30 and 32, as shown in dashed line in FIG. 1. Similarly, to mount a storage compartment in housing 14, the opposite ends of fixed panel 34 are inserted in a pair of corresponding slots 30 and 32, as shown in dashed line in FIG. 1.

Figure 2:
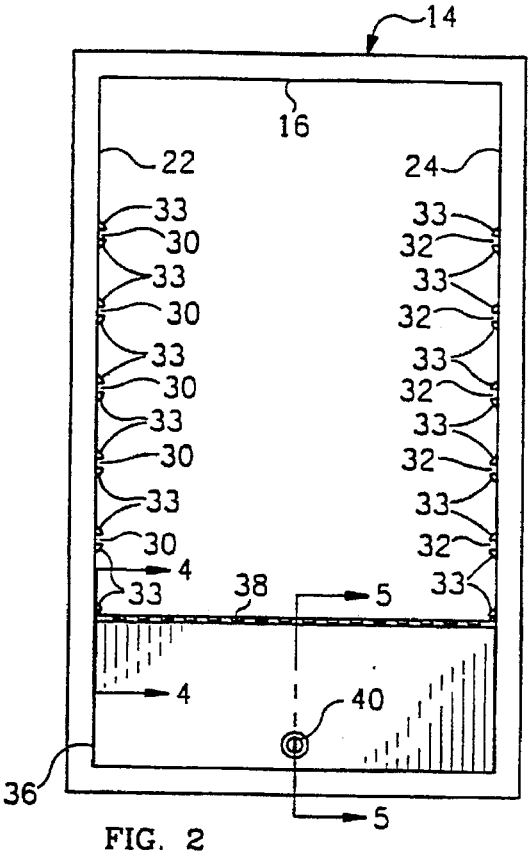
FIG. 2 is a front elevation view of the cabinet, showing the storage compartment installed at the bottom of the cabinet.
Figure 3:
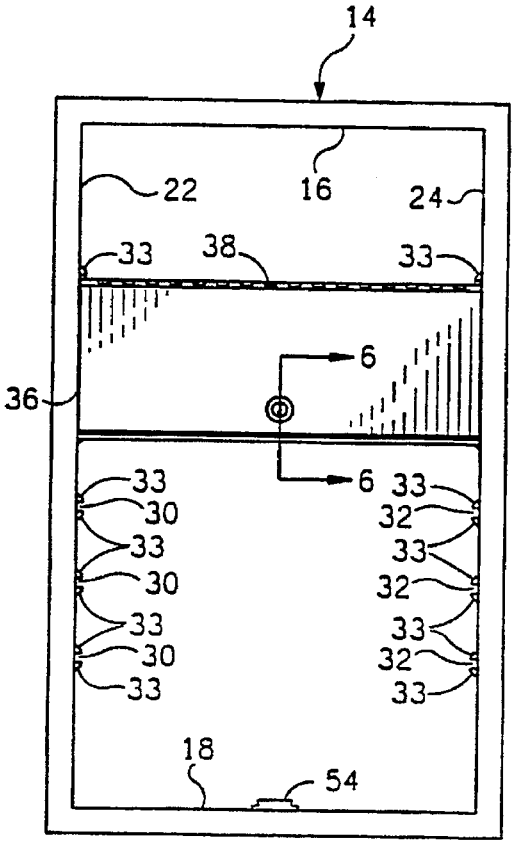
FIG. 3 is a front elevation view of the cabinet similar to FIG. 2, but showing the storage compartment installed at a different location in the cabinet.

As illustrated in FIGS. 2 and 3, when a storage compartment is mounted in housing 14, movable panel 36 forms a door that swings on hinge 38 to open or close the compartment. In the closed position, movable panel 36 hangs vertically downward from fixed panel 34. In the open position, movable panel 36 extends outwardly, as shown in dashed line in FIG. 5.

Storage compartment 10 may be mounted in any suitable location in housing 14. For example, storage compartment 10 may be mounted in the lowermost position in housing 14, as shown in FIG. 2. When movable panel 36 is in the closed position, its lower edge contacts lower wall 20 of housing 14. Articles (not shown) may be stored in storage compartment 10 by placing them on the upper surface of lower wall 18. Lower wall 20, in combination with fixed panel 34, movable panel 36, and portions of rear wall 21 and side walls 22 and 24, thus defines the interior space of the compartment. Alternatively, storage compartment i0 may, for example, be mounted in an intermediate location or the uppermost location in housing 14, as shown in FIG. 3. In this configuration, a shelf 12 must be mounted in housing 14 below storage compartment 10. When movable panel 36 is in the closed position, its lower edge contacts shelf 12. Articles (not shown) may be stored in storage compartment 10 by placing them on the upper surface of shelf 12. Shelf 12, in combination with fixed panel 34, movable panel 36, and portions of rear wall 21 and side walls 22 and 24, thus defines the interior space of the compartment. Movable panel 36 may be locked in the closed position, as described below.

In addition, when a storage compartment 10 is mounted in housing 14, articles (not shown) may be placed on the upper surface of fixed panel 34 for storage in the medicine cabinet in the same manner as articles placed on the upper surface of a shelf 12.

Figure 4:
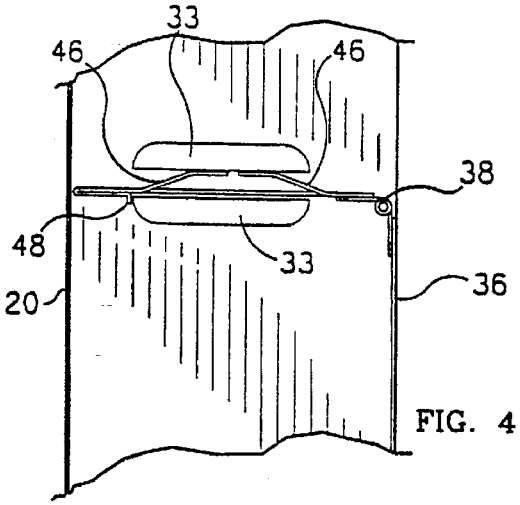
FIG. 4 is an enlarged sectional view taken on line 4—4 of FIG. 2.
Figure 5:
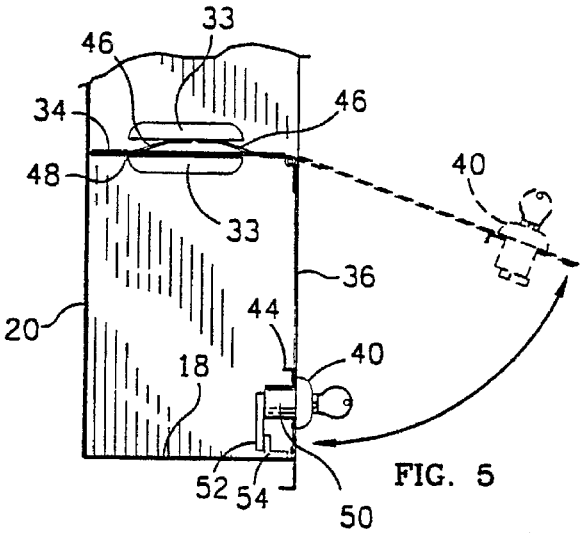
FIG. 5 is a sectional view taken on line 5—5 of FIG. 2.
Figure 6:
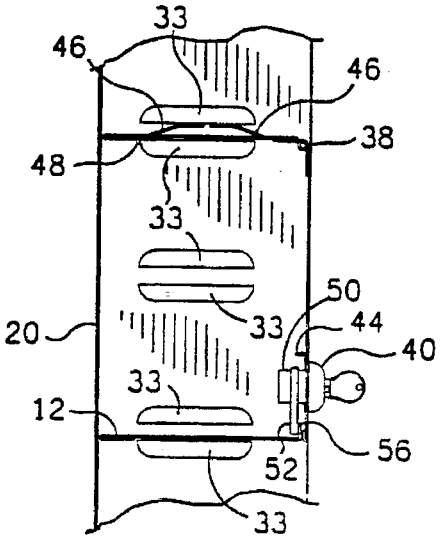
FIG. 6 is a sectional view taken on line 6—6 of FIG. 3.

As best illustrated in FIG. 4, fixed panel 34 has a catch, comprising two spring-tabs 46 and a projection 48. Spring-tabs 46 and projection 48 are formed by punching and bending the sheet metal of panel 34. Inserting fixed panel 34 into a slot 30 or 32 resiliently compresses spring-tabs 46 between ears 33. As fixed panel 34 is slid fully rearwardly in the slot, projection 48, which is biased downwardly against the lower one of the ears 33 by the force stored in spring-tabs 46, catches the rearward edge of that ear 33, as shown in FIGS. 4–6. To remove storage compartment 10 from housing 14, projection 48 must be disengaged and fixed panel 34 slid forwardly. To disengage projection 48 from the rearward edge of the ear 33, the lower surface of fixed panel 34 is pressed upwardly, thereby compressing spring-tabs 46. When movable panel 36 is locked in the closed position shown in FIGS. 2 and 3, however, access to the interior space of the compartment and access to the lower surface of fixed panel 34 is restricted. Storage compartment 10 therefore cannot easily be removed unless movable panel 36 is unlocked.

Although any suitable locking mechanism may be used, in the illustrated embodiment, lock 40 comprises a cylinder portion 50 having a rotary bolt 52. When storage compartment 10 is mounted in the lowermost position in housing 14, bolt 52 may engage a post 54 mounted on the upper surface of lower wall 18 of housing 14, as shown in FIG. 5. Alternatively, when storage compartment 10 is mounted in other locations in housing 14, bolt 52 may engage the upturned lip 56 of a shelf 12. In addition to this function, lip 56 also inhibits articles from sliding off shelf 12. Nevertheless, in other embodiments, posts similar to post 54 may be mounted on each shelf. In still other embodiments, lower wall 18 may itself have an upturned lip similar to lip 56. Furthermore, the upper surface of fixed panel 34 may have a post or a lip to allow one storage compartment 10 to be mounted immediately above another storage compartment 10. It should therefore be apparent to those of skill in the art that the medicine cabinet can be configured to provide multiple shelves 12 and/or multiple storage compartments 10. A user can easily change the configuration by moving shelves 12 or storage compartments 10 among the different vertical mounting positions or by replacing one or more shelves 12 with storage compartments 10 or vice versa.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A cabinet, comprising:

a housing comprising a first side wall, a second side wall, an upper wall, a lower wall, and a rear wall, said housing having a plurality of vertically spaced mountings for supporting a plurality of shelves, each of said shelves having two end tabs slideably engageable with said mountings;

a storage compartment comprising a fixed panel and a movable panel, said fixed panel hingedly connected to said movable panel, said fixed panel having two end tabs slideably engageable with said mountings; and a lock having a first lock portion on said movable panel and a second lock portion interengageable with said first lock portion on said lower wall of said housing.

2. A shelving system for a cabinet, said cabinet having a housing comprising a first side wall, a second side wall, an upper-wall, a lower wall, and a rear wall, said housing having a plurality of vertically spaced mountings for removably engaging a plurality of shelves in a plurality of mounting positions, said shelving system comprising:

a plurality of shelves, each having two end tabs slideably engageable with two said mountings at a selected one of said mounting positions;

a fixed panel having two end tabs slideable engageable with two said mountings at a selected one of said mounting positions;

a movable panel hingedly connected to said fixed panel, said movable panel having a lock, said movable panel and said fixed panel partially defining an interior compartment space;

said lock having a first lock portion on said movable panel and a second lock portion interengageable with said first lock portion on one of said plurality of shelves; and said fixed panel having a catch slideable into locking engagement with said mountings, said catch having a releasable portion in said interior compartment space when said movable panel is in said closed position.

3. The cabinet claimed in claim 2, wherein said catch comprises a resilient portion.

4. The cabinet claimed in claim 3, wherein:

said fixed panel is made of sheet metal; and said resilient portion is integrally formed with said sheet metal of said fixed panel.

5. The cabinet claimed in claim 3, wherein said catch has a portion that resiliently moves and disengages said fixed panel from said mounting in response to a force in a direction normal to said fixed panel and from said interior compartment space toward said fixed panel.

6. A storage compartment for a cabinet, said cabinet having a plurality of shelves, a housing comprising a first side wall, a second side wall, an upper wall, a lower wall, and a rear wall, said housing having a plurality of vertically spaced mountings for engaging said shelves in a plurality of mounting positions, said storage compartment comprising:

a fixed panel having two end tabs slideably engageable with two said mountings at a selected one of said mounting positions;

a movable panel hingedly connected to said fixed panel, said movable panel having a lock for locking said movable panel in a closed position in which said movable panel is perpendicular to said fixed panel, said movable panel and said fixed panel partially defining an interior compartment space; and said fixed panel having a catch slideable into locking engagement with said mountings, said catch having a releasable portion in said interior compartment space when said movable panel is in said closed position.

7. The cabinet claimed in claim 6, wherein said catch comprises a resilient portion.

8. The cabinet claimed in claim 7, wherein:

said fixed panel is made of sheet metal; and said resilient portion is integrally formed with said sheet metal of said fixed panel.

9. The cabinet claimed in claim 7, wherein said catch has a portion that resiliently moves and disengages said fixed panel from said mounting in response to a force in a direction normal to said fixed panel and from said interior compartment space toward said fixed panel.

* * * * *